United States Patent [19]

Greenewald, Jr.

[11] 4,080,509

[45] Mar. 21, 1978

[54] METAL PROCESSING FURNACE AND VAPOR NUCLEATION METHOD

[76] Inventor: Herbert Greenewald, Jr., 4296 Braunton Rd., Columbus, Ohio 43220

[21] Appl. No.: 653,158

[22] Filed: Jan. 28, 1976

[51] Int. Cl.[2] ..... H05B 7/18; C22B 4/00

[52] U.S. Cl. ..... 13/9 R; 75/10 R

[58] Field of Search ..... 75/10 R, 11; 13/9, 31, 13/35

[56] References Cited

U.S. PATENT DOCUMENTS

| | | | |
|---|---|---|---|
| 3,843,351 | 10/1974 | Smith | 75/10 R |
| 3,893,845 | 7/1975 | Mahaffey | 75/10 R |
| 3,917,479 | 11/1975 | Sayce | 75/10 R |

*Primary Examiner*—Peter D. Rosenberg

[57] ABSTRACT

A metal processing furnace of the indirect arc type employing opposed electrodes projected into an ionizable atmosphere is provided with novel filter-like, vapor nucleation means which enables the furnace to be utilized for numerous different metal melting/smelting operations in a manner which precludes the presence of metals and metal oxides in their vapor or particle forms in process effluent gases delivered from the furnace. The furnace achieves substantial operating advantages in the manufacture of ferroalloys, silicon and beryllium-copper metals, and comparable products including carbides such as silicon carbide.

5 Claims, 4 Drawing Figures

METAL PROCESSING FURNACE AND VAPOR NUCLEATION METHOD

SUMMARY OF THE INVENTION

An indirect arc metal processing furnace of the type having a closed and pressure-sealed outer shell is provided with an interiorly located crucible that is comprised of graphite and that receives the furnace metal values charge for melting or for reduction from a metal oxide form. A high temperature insulation layer of non-graphitic, porous carbon having a maximum bulk density of approximately 40 to 45 pounds per cubic foot is provided in the furnace in surrounding relation to the graphite crucible. A low temperature insulation layer of low-density, high-strength refractory free of both occluded water and water crystallization, such as foamed alumina-aluminum hydroxide refractory, is provided in surrounding relation to the porous carbon insulation and with its innermost face at a position on the furnace thermal gradient to ambient atmosphere which does not exceed approximately 2800° F. (1535° C.) The furnace shell is provided with a gas outlet for effluent gases and a non-graphitic, porous carbon nucleation filter passageway that extends from the crucible interior, passes through the graphite, porous carbon, and alumina refractory layers, and cooperates with the effluent gas outlet. An ionizable gaseous atmosphere, sometimes initially consisting of elemental argon, nitrogen, or the like and usually further comprised at the furnace operating temperature of metal vapors, metal oxide vapors, or vapors resulting from the reaction of a reductant with a metal oxide or element considered to be a metalloid (e.g., silicon), is contained within the graphite crucible. A pair of opposed electrodes are projected through appropriate furnace shell openings into the furnace crucible interior with the ionizable atmosphere and are energized preferably by a constant voltage, alternating current electrical energy supply. During operation of the furnace to melt or reduce the metal values charge contained within the crucible, and because of the flowing of all furnace effluent gases through the non-graphitic, porous carbon nucleation passageway, metal vapors and metal oxide vapors are apparently nucleated at the juncture of the nucleation filter passageway with the crucible interior at the graphite lining face and precluded from passage either as vapors or particles to the furnace effluent outlet. Under such operating conditions, the furnace is operated with a power factor of very nearly one as viewed from the electrode terminals thereby achieving improved electrical energy conversion efficiency. Also, metal values reduction operations may be carried out in accordance with the disclosed invention without having to provide a slag covering and without the formation of slag.

DETAILED DESCRIPTION

Figure 2:
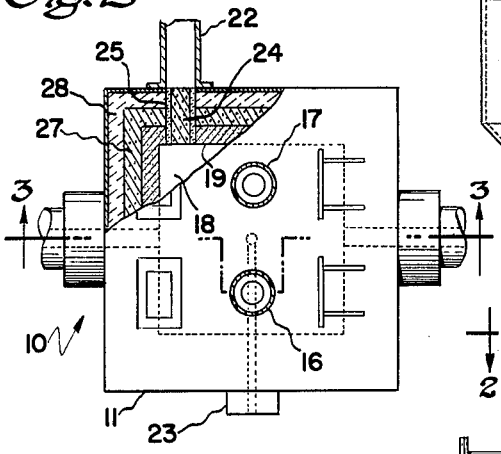
FIG. 2 is a partially sectioned plan view of the furnace of FIG. 1 from line 2—2 of FIG. 1.
Figure 1:
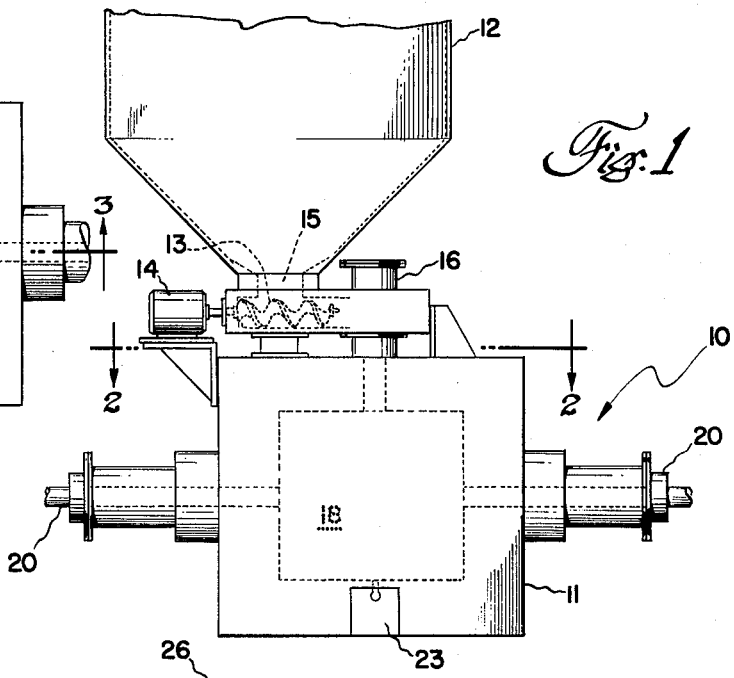
FIG. 1 is an elevational view of an indirect arc metal melting/smelting furnace constructed and operated in accordance with this invention.

A preferred embodiment of an indirect arc metal melting/smelting furnace incorporating the features of this invention is referenced generally as 10 in the drawings. Furnace 10 has an essentially closed and pressure-sealed exterior metal shell 11 that also serves as a support for charge hopper 12 and for a pair of charge feed screws 13, of which only one is illustrated in the drawings. Each such feed screw is controllably driven by an electric motor 14 and through a conventionally coupled reduction gear box arrangement (also not illustrated). Charge hopper 12 normally is made of metal, has bottom openings 15 that deliver charge material to feed screw assemblies 13, and should be provided with a charging dooor that is pressure sealed in its closed condition since furnace 10 operates without the presence of atmospheric gases within its interior crucible and frequently is advantageously operated with interior pressures either appreciably greater or appreciably less than atmospheric pressure.

Figure 4:
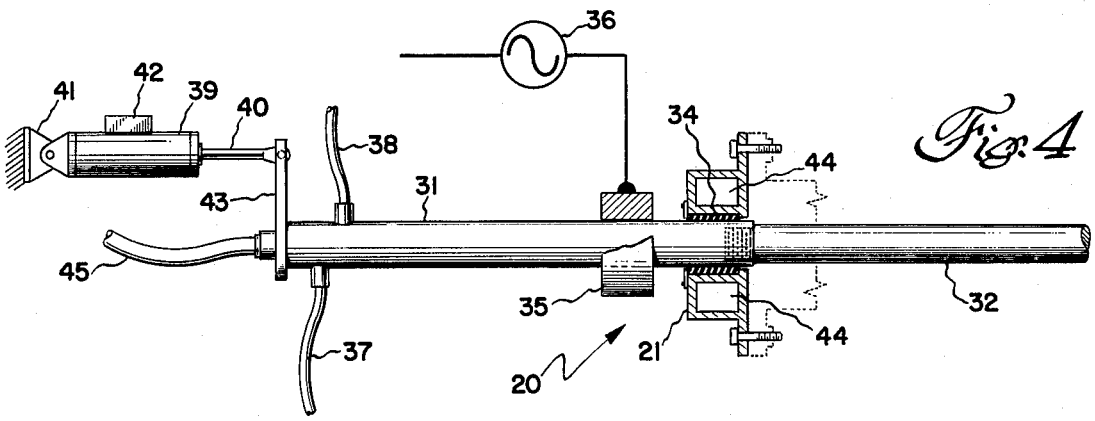
FIG. 4 is a schematic and partially sectioned elevational view of an electrode and electrode holder assembly useful with the furnace elements shown in FIGS. 1 through 3.

Feed screw assemblies 13 deliver furnace metal values charge material received from hopper 12 into vertically-oriented charge chutes 16 and 17 (FIG. 2). It is important that such charge chutes be located in shell 11 so that metal values charge material introduced into crucible interior 18 defined by graphite lining 19 does not fall either onto the furnace electrodes (32, FIG. 4) or into the indirect arc zones established within interior 18 between and during electrical energization of the electrodes.

Furnace system 10 also is provided with a pair of opposed electrode/electrode holder assemblies 20 that are each removably mounted through their respective bearing supports 21 on shell 11. Supports 21 are water-cooled and also are normally secured to shell 11 by conventional threaded fastener devices. Additional details regarding assemblies 20 are provided below in connection with the description of FIG. 4. An effluent gas outlet 22 (FIG. 2) and a tapping valve assembly illustrated only schematically as 23 are also provided in furnace 10. The valve assembly may be of conventional construction and is periodically operated to control the discharge of molten metal from the bottom of crucible interior 18 and through graphite crucible lining 19.

Figure 3:
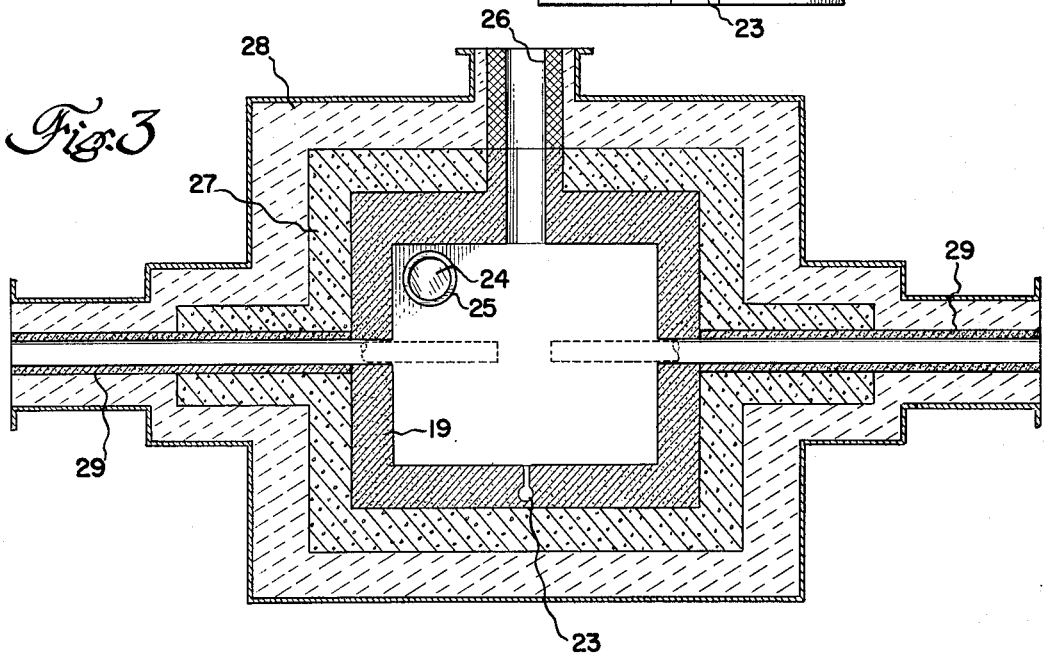
FIG. 3 is a sectional view of the furnace of FIG. 1 taken at line 3—3 of FIG. 2.

As shown in FIGS. 2 and 3, furnace 10 is also provided with a rigid porous nucleation filter passageway 24, bounded in part by an open-ended barrier tube 25, which cooperates with gas outlet 22. Filter passageway 24 is comprised of non-graphitic carbon having a rigid shape and having a maximum bulk density of approximately 40 to 45 pounds per cubic foot. In one satisfactory composition for passageway 24, the non-graphitic carbon had an acceptable impurity content of approximately 1.5% (by weight) ash. It is not presently known whether rigidized pure carbon at the specified bulk density is a satisfactory material for passageway 24.

Barrier tube 25 is impermeable to metal vapors and to metal oxide vapors and preferably is a dense graphite tube. The cross-sectional size or number of nucleation devices comprised of barrier 25/porous carbon filter passageway 24 and provided in furnace 10 may be varied depending on the volumetric rate at which furnace effluent gases are being produced. Only one such device is shown in the drawings. Also, extended nucleating surfaces may be developed for filter passageway element 24 by providing other than a flat configuration in the element face most adjacent to crucible interior 18.

The insulation linings incorporated into furnace 10 include a rigid non-graphitic porous carbon high temperature layer 27 installed in surrounding relation to graphite lining 19 and a foam-like refractory relatively low temperature insulation lining 28 installed in surrounding relation to porous carbon layer 27. Layer 27 preferably has the compositional and bulk density characteristics specified above in connection with the description of effluent gas nucleation passageway 24. Insulation layer 28 should be free of all occluded water and contain no water of crystallization. One satisfactory composition that has been utilized for layer 28 is comprised of alumina particles joined into a foam-like rigid shape by aluminum hydroxide bonds.

It is important that the face of lining 28 adjacent refractory lining 27 be located at a position on the thermal gradient extending from shell 11 to crucible interior 18 that does not exceed its reduction temperature with carbon. In the case of an alumina refractory lining 28, that temperature is approximately 2800° F. In the case of other types of relatively low temperature insulation such as zircon or silica free of all water, the thermal gradient temperature position is a substantially lower temperature and thus would require an appreciably greater thickness for layer 27 for most metal melting/-smelting furnace operating temperature conditions. If lining 28 is formed of a foamed water-free alumina a comparatively thinner porous carbon layer 27 may be utilized in the construction of furnace 10. Refractory lining 26 for charge chutes 16 and 17 is preferably also formed of the relatively low temperature insulation used in layer 27 even though that portion of the furnace construction is normally appreciably cooler than the portions containing molten metal or the indirect arc zones between electrode tips.

In the preferred furnace embodiment, assemblies 20 are projected into the crucible interior 18 through shell 11 and vapor barrier tubes 29. Tubes 29 are preferably formed of dense graphite as in the case of vapor barrier tube 25 since they also are believed to in part function as barriers to a flow of effluent gases in bypass relation to nucleation passageway 24. Each assembly 20 slidably cooperates with a water-cooled bearing support 21 and is basically comprised of a water-cooled electrode holder 31 and a mechanically and electrically attached electrode 32 that normally is formed of either graphite or tungsten. Assembly 20 is electrically insulated from support 21 and shell 11 by the insulating sleeve referenced as 34. Holder 31 slidably engages electrical brush 35 connected to one terminal of an alternating current power source 36. Hoses 37 and 38 furnish cooling water to and remove heated water from electrode holder 31. A hose 45 attached to the outboard end of holder 31 functions to inject either a gaseous or a granular solid ionizable atmosphere agent into a continuous passageway (not shown) that passes longitudinally through electrode holder 31 and electrode 32 for introduction into furnace interior 18.

A conventional hyraulic or pneumatic actuator cylinder 39 and a cooperating piston-rod member 40 are supported by furnace structure 41 and are controlled by valve 42 to advance or retract assembly 20 relative to shell 11. Rod 40 is connected through an insulator bar 43 to holder 31 to thus prevent the short circuiting of electrical energy between electrode brushes 35 through shell 11. Power input control to furnace 10 using a constant voltage alternating current supply is preferably achieved by controlling only the spacing or separation between the opposed electrodes 32 in crucible interior 18 in the presence of an ionizable atmosphere. Often the required interior atmosphere is developed at least in part from or by vapors produced in the melting or smelting operation carried on within the furnace.

A furnace constructed and operated in accordance with this invention has been utilized to produce high carbon ferrochrome alloys from metal values charges consisting of chromite ore and coal or coke. Such furnace has also been utilized to produce silicon carbide compounds by a reduction process in a pollution-free manner. The use of furnace system 10 for the production of ferrochrome alloys was accomplished without emitting metal/metal oxide vapors or particles from the furnace shell, without the formation or utilization of slag, and with the production of carbon monoxide suitable for recovery from the furnace effluent gas for its contained energy values. The production of silicon carbide was accomplished in a similar manner.

In the production of the ferrochrome alloys the approximate analysis of the chromite ore utilized was:

| Oxide | % by Weight |
|---|---|
| Chromium oxide ($Cr_2O_3$) | 43.3 |
| Iron oxide (FeO) | 24.2 |
| Aluminum oxide ($Al_2O_3$) | 13.8 |
| Magnesium oxide (MgO) | 14.3 |
| Silicon oxide ($SiO_2$) | 1.1 |
| Calcium oxide (CaO) | 4.1 |
| Total | 100.8 |

Also, the analysis for the utilized coal reductant was: 76.9% by weight fixed carbon; 16.1% by weight volatiles; 2.6% by weight moisture; and 4.4% by weight ash (silicon, aluminum, and iron oxides). Coke, when used as a reductant, has had (on a percentage weight basis): 98.5% fixed carbon and 1.5% ash in the case of calcined petroleum coke or 86.9% fixed carbon, 1.5% volatiles, 0.2% moisture, and 11.4% ash in the case of bituminous coal coke.

A furnace metal values charge consisting of a mixture of 74% by weight chromite ore (above analysis) and 26% by weight coal (above analysis) was introduced steadily from a closed hopper 12 by a feed screw/-charge chute assembly into a furnace crucible interior 18 having an ionized atmosphere. The furnace system was energized in accordance with the method teachings of my co-pending application Ser. No. 583,249 (filed June 3, 1975) to produce the ionized atmosphere or plasma and the crucible interior was maintained at a temperature in the range of approximately 3400°–3500° F. (1900° C.) The molten alloy tapped from the bottom of the furnace following reduction of the metal values charge had an approximate analysis of:

| Element | % by Weight |
|---|---|
| Chromium | 48.7 |
| Iron | 31.8 |
| Carbon | 8.2 |
| Silicon | 1.8 |
| Aluminum | 4.7 |
| Copper | 5.4 |
| Total | 100.6 |

(The copper constituent, and perhaps some aluminum in the alloy, is believed to be a carry-over from the immediately previous use of the furnace system for the production of an aluminum-copper alloy). Since the 1.53 chromium to iron ratio of the alloy compares favorably to the 1.56 chromium to iron ratio of the chromite ore actually charged, it is considered that the chromite ore was essentially completely reduced in the furnace system run.

A succeeding furnace system run utilized the same metal values charge mixture but developed a crucible interior temperature of approximately 3300° F. (1845° C.). The ferrochrome alloy produced in the additional run, by the reported analysis, did maintain the same chromium to iron ratio (1.53) and did have a reduced copper content (3.3%). In both runs there was no observed slag, either in or with the metal obtained from the furnace system or retained in the furnace. From the standpoint of furnace system emissions during such production of ferrochrome alloys, the novel porous carbon nucleation filter means was effective to preclude all particulate matter from the system effluent gas other than carbon black produced as a result of the intentional excess carbon included in the metal values charge reductant. Analysis of the effluent gas established that the principal constituents of the gas were: carbon monoxide (from the reduction reaction)—57.2%; hydrogen (from the pyrolysis of coal)—26.2%; nitrogen (introduced intentionally or from the coal)—14.7%; methane—1.0%; carbon dioxide—0.7%; and oxygen/argon—0.2%. (All percentage values are on a weight basis). Examination of the filter passageway 24 afterwards disclosed no ovservable retained metal or metal oxide particles. Also, no deterioration of the crucible graphite lining 19 was evident.

From the furnace system runs that have been completed it appears that temperatures of 3460° F. (1900° C.) may be preferred for the slag-free production of ferrochrome alloys. Appreciable lower temperature values at the crucible interior appear to be possible in the production of ferrochrome alloys with reduced aluminum contents but at the lower temperatures the complete reduction of the alumina constituent of the chromite ore without the formation of a viscous cover appears to be more difficult.

I claim:

1. In an indirect arc furnace for the processing of a metal values charge material at temperature conditions which produce vapors from the group comprised of metal vapors and metal oxide vapors, in combination:

(a) a pressure-sealed furnace shell having a metal values material charging opening, a metal discharging opening, and an effluent gas outlet;

(b) a crucible formed of graphite positioned within said furnace shell and having an interior that receives metal values charge material from said furnace shell charging opening and that communicates with said furnace shell discharging opening;

(c) a rigid, first insulation layer within said furnace shell, contacting and surrounding said graphite crucible, and comprising porous, non-graphitic carbon having a maximum bulk density of approximately 45 pounds per cubic foot; and (d) a rigid, second insulation layer within said furnace shell, contacting and surrounding said first insulation layer, and comprising refractory particles free of water of crystallization, said second insulation layer contacting said first insulation layer at a temperature position on the furnace thermal gradient extending from said furnace shell to said graphite crucible that is less than the reduction temperature of said bonded refractory particles in the presence of carbon.

2. The invention defined by claim 1 wherein said bonded refractory particles are bonded alumina particles, said bonded alumina particles contacting said first insulation layer at a thermal gradient temperature position of approximately 2800° F.

3. The invention defined by claim 1 wherein there is also combined a porous effluent gas passageway extending in a gas flow direction from said graphite crucible interior to said furnace shell effluent gas outlet, said gas passageway being comprised of porous, non-graphitic carbon having a maximum bulk density of approximately 45 pounds per cubic foot.

4. The invention defined by claim 3 wherein said porous, non-graphitic carbon effluent gas passageway is surrounded by a dense, graphite vapor barrier in those gas passageway zones passing through said first and second insulation layers.

5. In a indirect arc furnace for the processing of a metal values charge material at temperature conditions which produce vapors from the group comprised of metal vapors and metal oxide vapors, filter means comprising porous, non-graphitic carbon having a furnace interior face that nucleates vapors produced from said metal values charge.

* * * * *